United States Patent [19]

Luberto

[11] Patent Number: 5,000,329

[45] Date of Patent: Mar. 19, 1991

[54] DISPLAY STAND

[75] Inventor: Michael D. Luberto, Edgewater, N.J.

[73] Assignee: Henschel-Steinau, Inc., Englewood, N.J.

[21] Appl. No.: 502,416

[22] Filed: Mar. 30, 1990

[51] Int. Cl.[5] ..... A47F 1/00

[52] U.S. Cl. ..... 211/132; 211/133; 211/72

[58] Field of Search ..... 211/132, 133, 128, 73, 211/194, 72; 248/174; 108/153, 157, 111; 220/23.83, 85 H

[56] References Cited

U.S. PATENT DOCUMENTS

| | | | |
|---|---|---|---|
| 3,508,734 | 4/1970 | Thomas | 248/174 X |
| 4,519,319 | 5/1985 | Howlett | 248/174 X |
| 4,678,088 | 7/1987 | Flum | 211/73 |

*Primary Examiner*—Sarah A. Lechok

*Attorney, Agent, or Firm*—Samuelson & Jacob

[57] ABSTRACT

A display stand erected from component parts of sheet material, such as corrugated paperboard, includes display trays received within notches in vertical columns secured at the lower ends of the columns to a base and bridged at the upper ends of the columns by a header such that the notches each establish a bight which is biased into clamping engagement with the display trays to secure the display trays and the columns within a rigid integrated assembly.

10 Claims, 4 Drawing Sheets

DISPLAY STAND

The present invention relates generally to display stands and pertains, more specifically, to display stands of the type stored and transported in a compact, disassembled state and erected readily at a selected site for displaying merchandise at a point of purchase Display stands are furnished routinely by manufacturers and distributors of goods to stores and other outlets to assist in the sale of their goods Often, these display stands merely are temporary structures erected at a selected point of purchase to promote the sale of a particular product at that site Thus, an effective display stand of this type should be compact, for economy of storage and transportation, should be inexpensive, for wide distribution and use and for expendability, and should be easy to put in place at the site and provide an aesthetically pleasing appearance to promote the sale of the goods displayed at the site.

A wide variety of display stands is available for the above purposes. Many of these are fabricated of sheets of inexpensive material, such as corrugated paperboard, and are constructed for flat shipping and storage and easy erection at the site. The present invention provides an improved display stand of the type described above, having objects and exhibiting advantages, some of which may be summarized as follows Simple construction which is packaged readily into a compact, relatively flat package for ease of storage and transportation, yet is erected readily on the site, using a simplified procedure, to provide a sturdy, durable, relatively rigidly integrated free-standing display stand which is versatile and attractive; inexpensive construction to enable widespread use and expendability; versatility in design and construction, as well as in end use, for adaptability to a variety of point-of-purchase requirements; ease of erection enabling correct set-up without the need for tools or special skills; and economy of manufacture in large numbers of consistent high quality The above objects and advantages, as well as further objects and advantages, are attained by the present invention which may be described briefly as a display stand capable of being erected readily from component parts constructed of sheet material, such as corrugated paperboard, the display stand comprising: a display tray extending between opposite ends and having a section of prescribed thickness located at each of the opposite ends; at least two columns for placement one at each of the opposite ends of the display tray, each column having a notch with an opening facing the opposite column to establish a pair of opposed notches and provide a bight at each of the opposite ends of the display tray, the bight having a gap enabling reception of the corresponding section of the display tray into the corresponding notch for supporting the display tray between the opposite columns within the pair of opposed notches; flexible means in each column and associated with the notch in the column for enabling opening of the bight for reception of the corresponding section of the display tray into the notch and subsequent closing of the bight into a closed condition against the section of the display tray received within the notch; and bridging means for bridging the opposite columns and for being secured to the columns in bridging arrangement so as to bias the bight of each column toward the closed condition of the bight into clamping engagement with the corresponding section of the display tray received within the notch of the column to integrate the display tray with the columns in a relatively rigid erected display stand.

The invention will be understood more fully, while still further objects and advantages will become apparent, in the following detailed description of a preferred embodiment of the invention illustrated in the accompanying drawing, in which.

Figure 1:
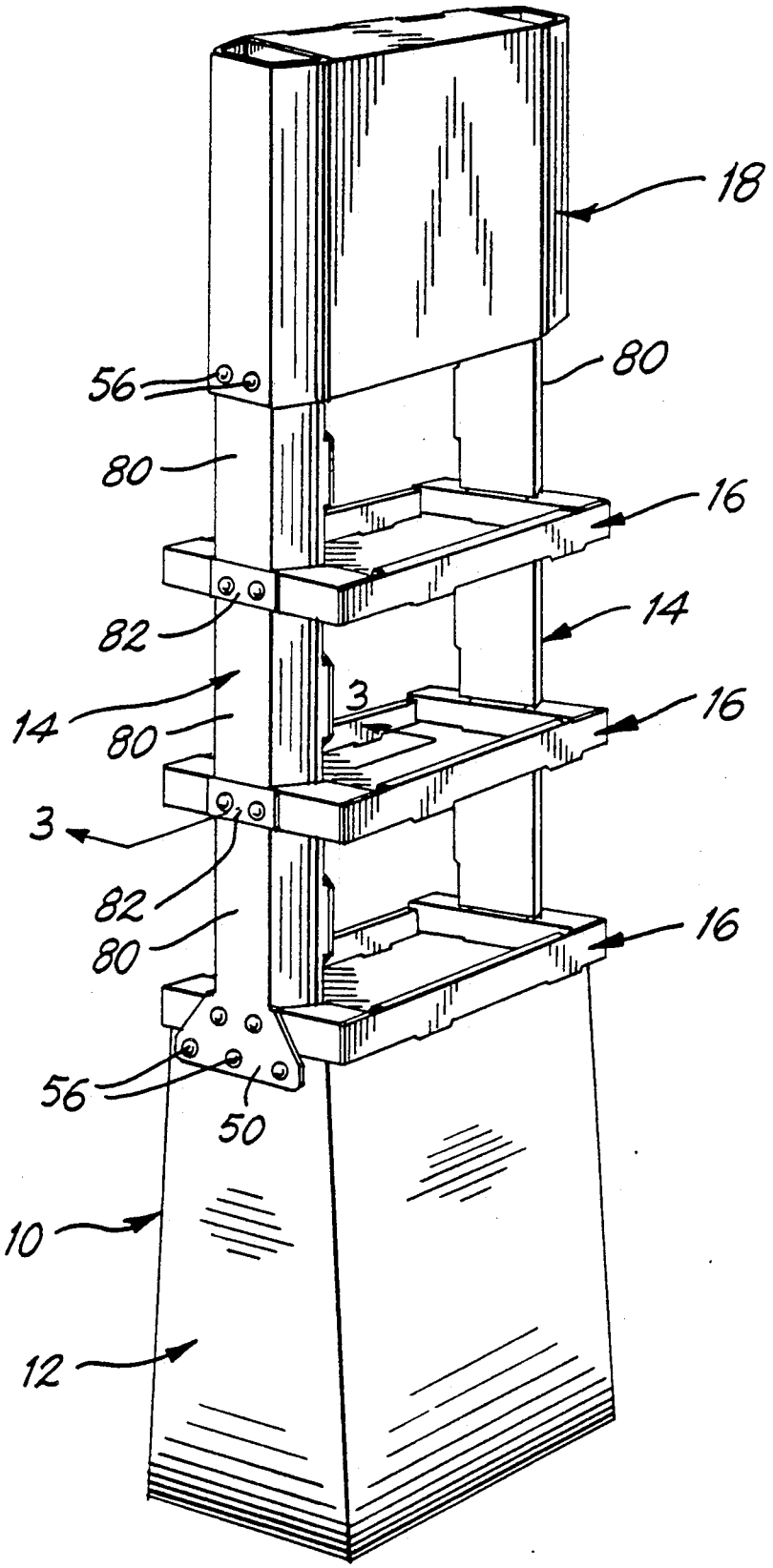
FIG. 1 is a perspective view of a display stand constructed in accordance with the invention, erected at a selected site

Referring now to the drawing, and especially to FIG. 1 thereof, a display stand constructed in accordance with the invention is illustrated at 10 and is seen to include a base 12, a pair of vertical columns 14 secured to the base 12 and extending upwardly from the base 12, a plurality of display trays 16 extending between the vertical columns 14 and spaced vertically from one another along the columns 14 for displaying merchandise, and a header 18 bridging the columns 14 at the top of the columns 14.

Figure 2:
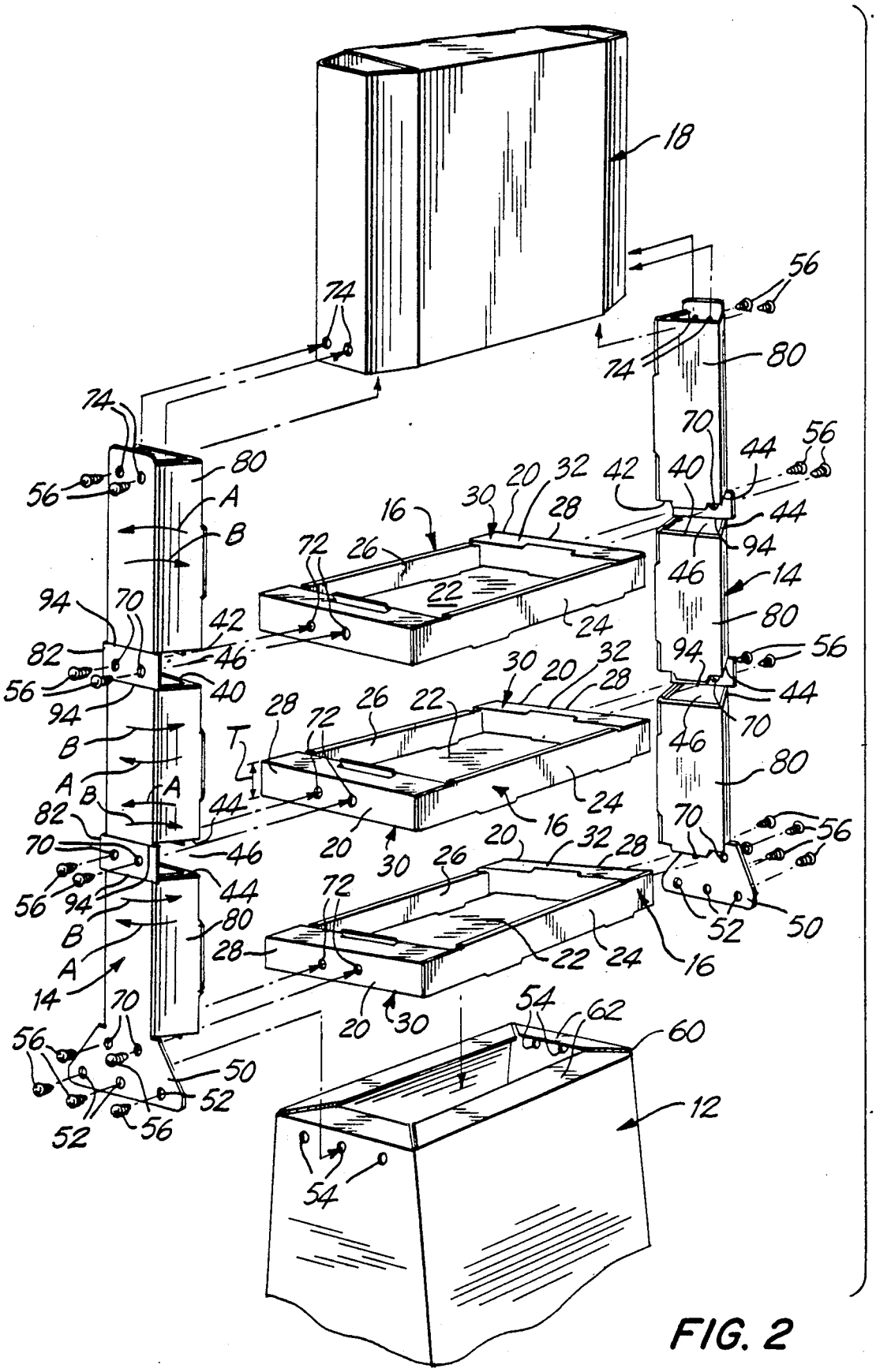
FIG. 2 is an exploded perspective view of the display stand.

Turning now to FIG. 2, each display tray 16 extends between opposite ends 20 and includes a bottom 22 bounded by a front wall 24 at the front of the tray 16, a rear wall 26 at the rear of the tray 16, and end walls 28 at the opposite ends 20. Each end wall 28 is in the form of a box-like member 30, a central portion of which provides a section 32 of prescribed thickness T at each end 20 of the trays 16. Columns 14 each have a plurality of notches 40 corresponding to the ends 20 of the trays 16. The notches 40 each include an opening 42 and confronting edges 44 so that each notch 40 establishes a bight 46 within which a corresponding section 32 of a tray 16 is received Corresponding notches 40 in the opposite columns 14 are arranged with the openings 42 facing one another so that the trays 16 will extend between the columns 14 and each section 32 will be received within a corresponding notch 40, as seen in FIG. 1.

In order to erect display stand 10, a flange 50 at the lower end of each column 14 is provided with apertures 52 which are aligned with counterpart apertures 54 in the base 12 for the reception of fasteners 56 inserted through aligned apertures 52 and 54 to secure flange 50 to the base 12. A lowermost tray 16 is placed upon the upper end 60 of the base 12, the base 12 including a plurality of flaps 62 at the upper end 60 for providing added support for the lowermost tray 16 placed upon the upper end 60 of the base 12. Sections 32 of the lowermost tray 16 are received between the upper end 60 of the base 12 and the edges 44 on the columns 14. Likewise, the corresponding sections 32 of each of the additional trays 16 are received within the notches 40 in the opposite columns 14 to place the trays 16 in the erected display stand 10. Once all of the trays 16 are in place, header 18 is secured at the top end of each column 14 to bridge the columns 14 at the top ends thereof. Additional fasteners 56 are inserted through pairs of apertures 70 in the columns 14 and aligned counterpart pairs of apertures 72 in the trays 16 and apertures 74 in the header 18 to complete the erection.

Figure 3:
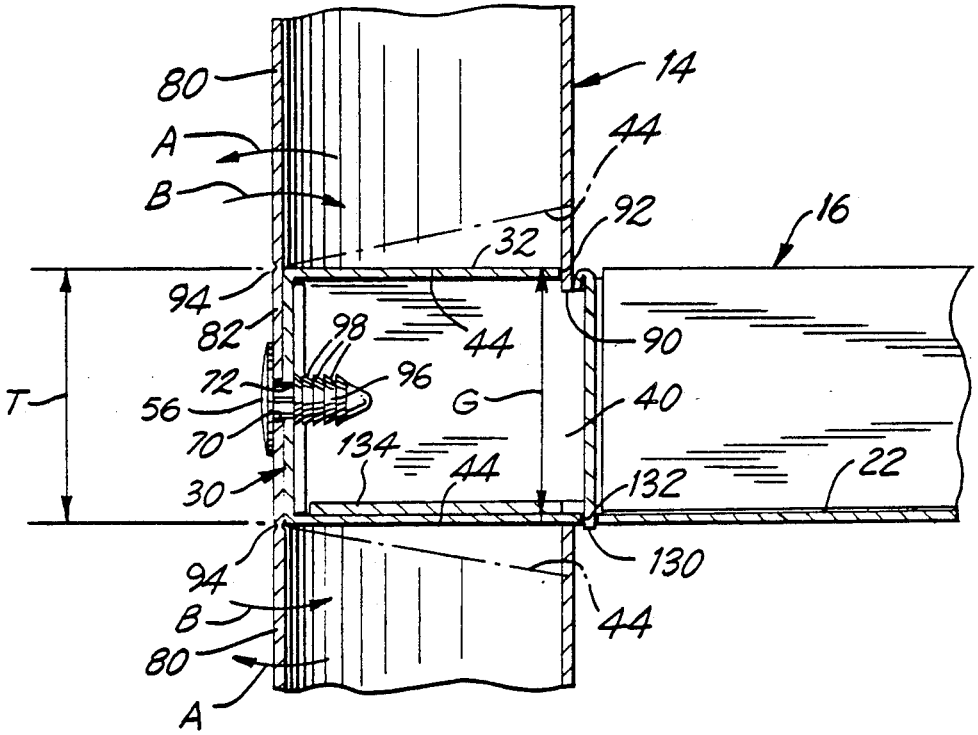
FIG. 3 is an enlarged fragmentary cross-sectional view taken along line 3—3 of FIG. 1.

As best seen in FIGS. 2 and 3, the columns 14 include relatively rigid segments 80 interconnected at notches 40 by somewhat flexible webs 82 so that the bight 46 provided at each notch 40 may be opened to admit a corresponding section 32 of a tray 16, by swinging adjacent segments 80 away from one another, in the direction of the arrows A, to move the confronting edges 44 apart, as illustrated in phantom. Once a section 32 is admitted within a notch 40, the bight 46 is closed by swinging the adjacent segments 80 toward one another, in the direction of arrows B, and the confronting edges 44 are moved toward one another and are urged against the section 32 to clamp the section 32, and the tray 16, in place. The lowermost tray 16 is clamped between an edge 44 and the upper end 60 of the base 12 in a similar fashion. When all of the trays 16 are in place, the header 18, which serves as a bridging member, is secured across the top of the assembly to bridge the columns 14 and, acting in concert with the securement of the columns 14 to the base 12, biases the bights 46 into the closed condition in which the confronting edges 44 of the notches 40 clamp the sections 32 in place to integrate the trays 16 with the columns 14 in a relatively rigid completed assembly Preferably, the two columns 14 are placed intermediate the front and the rear of the trays 16, for structural balance as well as for enhanced aesthetic appeal.

In order to enhance further the rigidity of the assembled display stand 10, the relative dimensions of the thickness T of the section 32 of each tray 16 and the gap G between the confronting edges 44 of the notch 40 preferably is such that the gap G is slightly less than the thickness T when the bight 46 is in the closed condition. In this manner, the confronting edges 44 are urged against and grip the sections 32 firmly to clamp the trays 16 securely within the notches 40 of the columns 14 and assure a rigidly integrated structure in the assembled display stand 10. As an added measure, a tab 90 on the columns 14 at each notch 40 enters a slot 92 in each section 32 of the trays 16 to positively lock each tray 16 in place in the assembly It is noted that while the webs 82 are flexible and constitute flexible means allowing the bights 46 to be opened for admitting the sections 32 and closed for clamping the sections 32 between confronting edges 44 of the notches 40, flexibility preferably is enhanced by providing bend lines 94 associated with each notch 40, about which bend lines 94 the segments 80 of the columns 14 can swing more readily Fasteners 56 are of the push-in type and have a fir-tree configuration 96 which enables ease of entry and provides barbs 98 for anchoring the fasteners 56 in place. Box-like members 30 have a full rectangular cross-sectional configuration and extend entirely across each tray, 16 from the front wall 24 to the rear wall 26 of the tray 16, so that not only is section 32 of each tray 16 reinforced by a full box-like structure against crushing when bight 46 is closed, but the same reinforcing structure lends further rigidity to the entire tray 16 itself.

Figure 4:
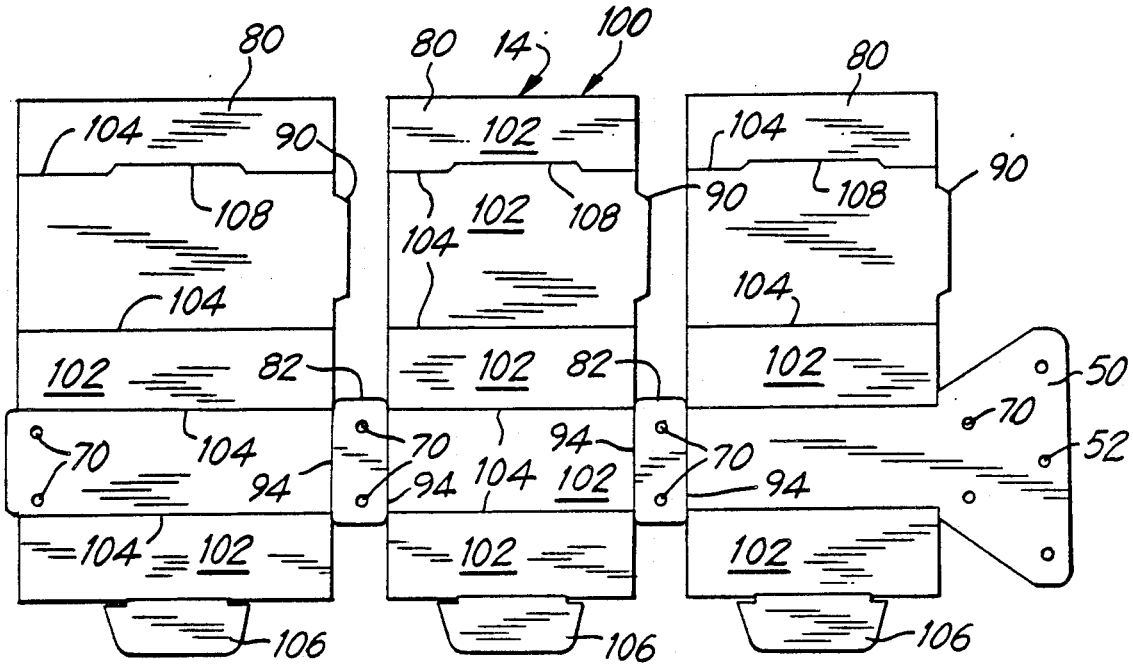
FIG. 4 is a plan view of a flat blank for erecting a component part of the display stand.

The above-described construction lends itself readily to compact storage and transportation, as well as inexpensive fabrication, since the major component parts are constructed readily of a common sheet material, such as corrugated paperboard, for flat storage and transportation and ready erection at a selected site. Thus, as seen in FIG. 4, the columns 14 each preferably are erected from a flat blank 100 cut from a sheet of corrugated paperboard to provide the segments 80, webs 82 and flange 50. The bend lines 94 are scored. Each segment 80 includes a plurality of panels 102 divided by score lines 104 so that the panels 102 may be folded into a trapezoidal cross-sectional configuration and locked in that configuration by a tab 106 which enters a slot 108. The trapezoidal cross-sectional configuration provides an aesthetically pleasing appearance, as well as the desired rigidity in the erected structure.

Figure 5:
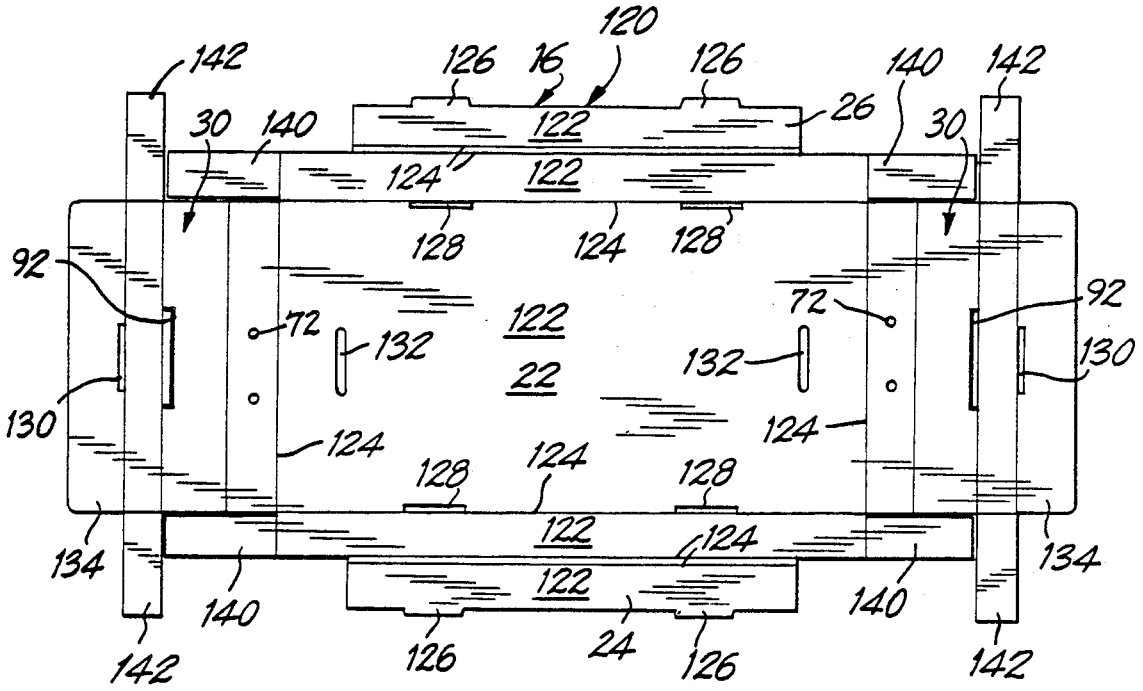
FIG. 5 is a plan view of another flat blank for erecting another component part of the display stand.
Figure 6:
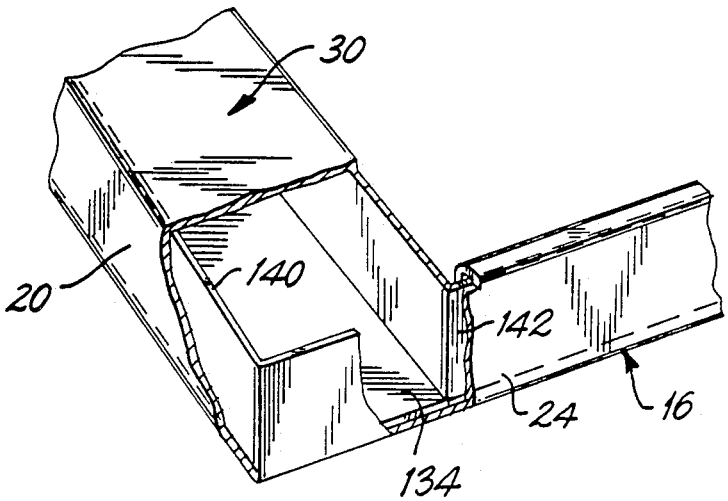
FIG. 6 is an enlarged fragmentary perspective view partially sectioned, illustrating details of construction of a component part.

As seen in FIG. 5, each tray 16 preferably is erected from a flat blank 120 in which a plurality of panels 122 are delineated by score lines 124 to establish the bottom 22, the front wall 24, the rear wall 26 and the box-like members 30. Tabs 126 enter slots 128 to secure the panels 122 which form the front wall 24 and the rear wall 26. Likewise, a tab 130 enters a slot 132 upon erection of each box-like member 30. Each box-like member 30 has a bottom wall portion 134 which lies against the bottom 22 of the tray 16, when the tray 16 is erected (see FIG. 3), for added strength and rigidity. Tongues 140 at the opposite ends of the front wall 24 and the rear wall 26 enter the box-like member 30, and tongues 142 at the front and rear of the box-like member 30 enter the front wall 24 and the rear wall 26, as seen in FIG. 6, for added reinforcement and securement of the walls in the erected tray 16. Base 12 and header 18 also are erected readily from flat blanks (not shown) in a similar manner.

It will be seen that the present invention attains the several objects and advantages set forth herein and summarized as follows: Simple construction which is packaged readily into a compact, relatively flat configuration for ease of storage and transportation, yet is erected readily on the site, using a simplified procedure, to provide a sturdy, durable, relatively rigidly integrated free-standing display stand which is versatile and attractive; inexpensive construction to enable widespread use and expendability; versatility in design and construction, as well as in end use, for adaptability to a variety of point-of-purchase requirements; ease of erection enabling correct set-up without the need for tools or special skills; and economy of manufacture in large numbers of consistent high quality.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A display stand capable of being erected readily from component parts constructed of sheet material, such as corrugated paperboard, the display stand comprising:

a display tray including opposite ends and having a section of prescribed thickness located at each of the opposite ends;

at least two columns for placement one at each of the opposite ends of the display tray, each column having a notch with an opening facing the opposite column to establish a pair of opposed notches and provide a bight at each of the opposite ends of the display tray, the bight having a gap enabling reception of the corresponding section of the display tray into the corresponding notch for supporting the display tray between the opposite columns within the pair of opposed notches;

flexible means in each column and associated with the notch in the column for enabling opening of the bight for reception of the corresponding section of the display tray into the notch and subsequent closing of the bight into a closed condition against the section of the display tray received within the notch; and bridging means for bridging the opposite columns and for being secured to the columns in bridging arrangement so as to bias the bight of each column toward the closed condition of the bight into clamping engagement with the corresponding section of the display tray received within the notch of the column to integrate the display tray with the columns in a relatively rigid erected display stand.

2. The invention of claim 1 wherein the gap of each bight, when the closed condition, is somewhat less than the prescribed thickness of the section of the display tray received within the bight so that the section is clamped firmly within the notch when the bight is biased toward the closed condition for relatively rigid integration of the display tray with the columns.

3. The invention of claim 1 wherein the display tray includes a box-like member at each of the opposite ends of the display tray, each box-like member having a rectangular cross-sectional configuration, and each section comprises a portion or the corresponding box-like member.

4. The invention of claim 3 wherein the display tray includes a front and a rear and each box-like member extends from the front of the display tray to the rear of the display tray.

5. The invention of claim 4 wherein the columns each are arranged for location intermediate the front and the rear of the display tray.

6. The invention of claim 5 wherein the gap of each bight, when in the closed condition, is somewhat less than the prescribed thickness of the section of the display tray received within the bight so that the section is clamped firmly within the notch when the bight is biased toward the closed condition for relatively rigid integration of the display tray with the columns.

7. The invention of claim 1 including a plurality of display trays and a plurality of pairs of opposed notches, the pairs of opposed notches being spaced from one another for the reception of each of the plurality of display trays spaced apart from one another.

8. The invention of claim 7 wherein the gap of each bight, when in the closed condition, is somewhat less than the prescribed thickness of the section of the display tray received within the bight so that the section is clamped firmly within the notch when the bight is biased toward the closed condition for relatively rigid integration of the display trays with the columns.

9. The invention of claim 1 wherein the bridging means includes a base and attachment means for securing the columns to the base such that the columns extend in a vertical direction, and wherein the display tray extends horizontally between the columns, vertically above the base, when the sections of the display tray are received within the corresponding notches of the columns, and the bridging means further includes a bridging member extending horizontally between the columns, vertically above the display tray, when the bridging means bridges the columns.

10. The invention of claim 9 wherein the gap of each bight, when in the closed condition, is somewhat less than the prescribed thickness of the section of the display tray received within the bight so that the section is clamped firmly within the notch when the bight is biased toward the closed condition for relatively rigid integration of the display tray with the columns.

* * * * *